United States Patent [19]

Nielsen, Jr. et al.

[11] Patent Number: 4,483,164

[45] Date of Patent: Nov. 20, 1984

[54] HIGH SECURITY LOCKS AND KEY

[75] Inventors: Anker J. Nielsen, Jr., Holden; Richard E. Hoyt, Worcester, both of Mass.

[73] Assignee: Omco Inc., Holden, Mass.

[21] Appl. No.: 570,992

[22] Filed: Jan. 16, 1984

Related U.S. Application Data

[62] Division of Ser. No. 394,446, Jul. 1, 1982, Pat. No. 4,441,343.

[51] Int. Cl.[3] ..... E05B 19/12

[52] U.S. Cl. ..... 70/399; 70/398

[58] Field of Search ..... 70/32–34, 70/386, 395–400; 292/177, 341.17

[56] References Cited

U.S. PATENT DOCUMENTS

| | | | |
|---|---|---|---|
| 3,478,548 | 11/1969 | Finck | 70/397 |
| 4,040,279 | 8/1977 | Signorelli et al. | 70/395 X |
| 4,155,232 | 5/1979 | Haus et al. | 70/395 X |

*Primary Examiner*—Gary L. Smith

*Assistant Examiner*—Russell W. Illich

*Attorney, Agent, or Firm*—Thompson, Birch, Gauthier & Samuels

[57] ABSTRACT

A high security lock and a high security key for locking and unlocking said lock. The lock has a resilient O-ring seated in the bore of a hollow plunger and a retainer sleeve fixed in the bore of the hollow plunger and bearing against the rear surface of the O-ring. A center pin with an enlarged forward head extends rearwardly through the bore of the plunger, the O-ring gripping the periphery of the center pin and yieldably resisting center pin reciprocal movement within the plunger bore. The key has elongated outer expanding fingers and an inner coaxially arranged center pin. When the key is fully inserted into the lock and the key handle is operated, the expanding fingers are initially radially expanded to grip the inner surface of the lock plunger bore, and are then longitudinally retracted to draw the plunger rearwardly. Simultaneously, the key center pin is prevented from retracting and holds the lock center pin stationary permitting the lock to unlock.

7 Claims, 12 Drawing Figures

HIGH SECURITY LOCKS AND KEY

This application is a division of application Ser. No. 394,446, filed July 1, 1982, now U.S. Pat. No. 4,441,343.

BACKGROUND OF THE INVENTION

Prior art barrel locks and keys are shown in U.S. Pat. Nos. 1,923,025; 3,002,368; and 3,835,674. The disclosures of these patents are incorporated by reference and made a part of the present disclosure. These prior art locks and keys have become increasingly less secure with the passage of time because of the relatively wide, albeit substantially controlled, distribution and use of the keys by a large number of people.

It is the object of this invention to provide a high security lock which cannot be opened with a conventional key or with picks or nails.

It is also the object of this invention to provide a high security key which is uniquely designed to open the aforesaid high security lock, in addition to also being able to open the previously mentioned prior art locks.

SUMMARY OF THIS INVENTION

The high security lock of this invention is similar in many respects to the prior art locks. However, a resilient O-ring is seated against the plunger bore annular shoulder, and a hollow cylindrical open-ended retainer sleeve is fixed against axial movement within the rear interior bore of the plunger forcing and maintaining the O-ring against the plunger bore annular shoulder.

A lock center pin has an enlarged head at its front end and has a rearwardly extending shaft. The outer diameter of the lock center pin head corresponds to the outer diameter of the front exterior portion of the plunger. The lock center pin shaft extends rearwardly through the front end of the plunger bore and also extends through and is resiliently gripped by the O-ring. The O-ring yieldably resists the lock center pin's reciprocal movement within the plunger bore.

The high security key of this invention is specifically designed to open the high security lock of this invention. It is somewhat similar to the prior art keys. However, a key center pin is telescopically provided within the outer expanding fingers. The purpose of the key center pin is to block all rearward axial movement of the lock center pin when the lock is being unlocked.

The key has a plunger which is reciprocated by a key handle. The plunger has a transverse elongated slot through which a stop pin is fixed against rearward movement down the barrel. The stop pin blocks rearward axial movement of the key center pin during rearward axial movement of the key plunger.

In cooperation with the biasing forces of three telescopically mounted coil springs, the key plunger is retracted by the key handle causing the expanding fingers to initially spread radially and then to retract axially while the key center pin remains stationary.

Thus, when the key is inserted into the lock, the lock is caused either to become locked or to remain locked. Then, when the key handle is operated, the lock plunger is retracted by the key's expanding fingers, and the lock center pin is prevented by the key center pin from retracting. This dual action permits the locking balls to move radially inwardly to their unlocking position and permits the unlocked lock to then be withdrawn entirely.

DESCRIPTION OF THE DRAWINGS

FIG. 7 shows the springless lock and corresponds to FIG. 2, which shows the spring lock, both figures showing the key handle of the inserted key in its first position.

DESCRIPTION OF THE PREFERRED EMBODIMENTS

Figure 1:
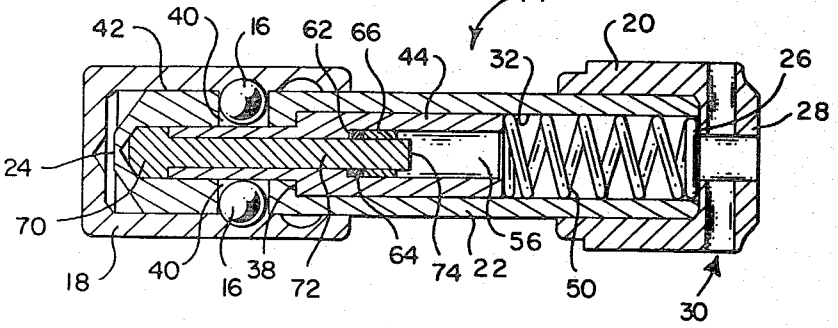
FIG. 1 is a vertical section of the first preferred embodiment of the lock of this invention, hereafter called the spring lock.
Figure 6:
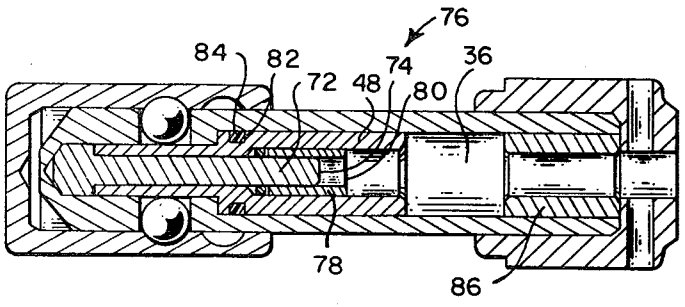
FIG. 6 is a vertical section of the second preferred embodiment of the lock of this invention, hereafter called the springless lock.

FIG. 1 shows the spring lock which differs somewhat from the springless lock of FIG. 6. Both locks can be unlocked and locked by the FIG. 7 key, although the springless lock can also be locked by the FIG. 11 dumb key.

FIG. 1 shows spring lock 14 in its locked condition wherein its two locking balls 16 have been forced radially outwardly so that they engage in a groove in a front end cap 18. Thus, when spring lock 14 is in its FIG. 1 locked condition, it cannot be longitudinally removed from front end cap 18.

Spring lock 14 can be used in many situations to lock two elements against various types of relative movement. Front end cap 18 illustrates but one locking situation of the type wherein two unshown apertured flat panels have the lock inserted through both and the two flat panels are prevented from separating by the large rear end cap 20 of the lock on one side and the large front end cap 18 on the other side. There are many other situations in which spring lock 14 is useful.

Spring lock 14 has a hollow cylindrical lock barrel 22 which has a closed front end 24 and an open rear end 26. Rear end cap 20 is fitted over and fixed to open rear end 26 enlarging its effective outer diameter and creating an apertured rear end 28 with a selected aperture size. A transverse passage 30 is also provided to accommodate a conventional "tell tale" or lead seal used to signal tampering.

The spring lock barrel 22 has a stepped axially extending bore 32 including a front small diameter bore 34 and a rear large diameter bore 36. The diameters are small and large relative to each other. The front bore 34 is joined to the rear bore 36 by an annular shoulder 38, the surface of which extends perpendicular to the axis of the barrel bore 32. As will be seen, the function of annular shoulder 38 is to act as a plunger seat.

The lock barrel 22 also has two radially extending passageways 40 which run from the exterior surface 42 of barrel 22 to the front bore 34 of the lock barrel 22. The steel locking balls 16 are movably mounted in the passageways and are free to move radially within the passageways. At the outer aperture of each passageway, a very small inwardly extending peripheral rim is provided which prevents the locking ball from completely escaping outwardly. However, almost half of the locking ball can project outwardly from the passageway as can be seen from FIG. 1.

Figure 2:
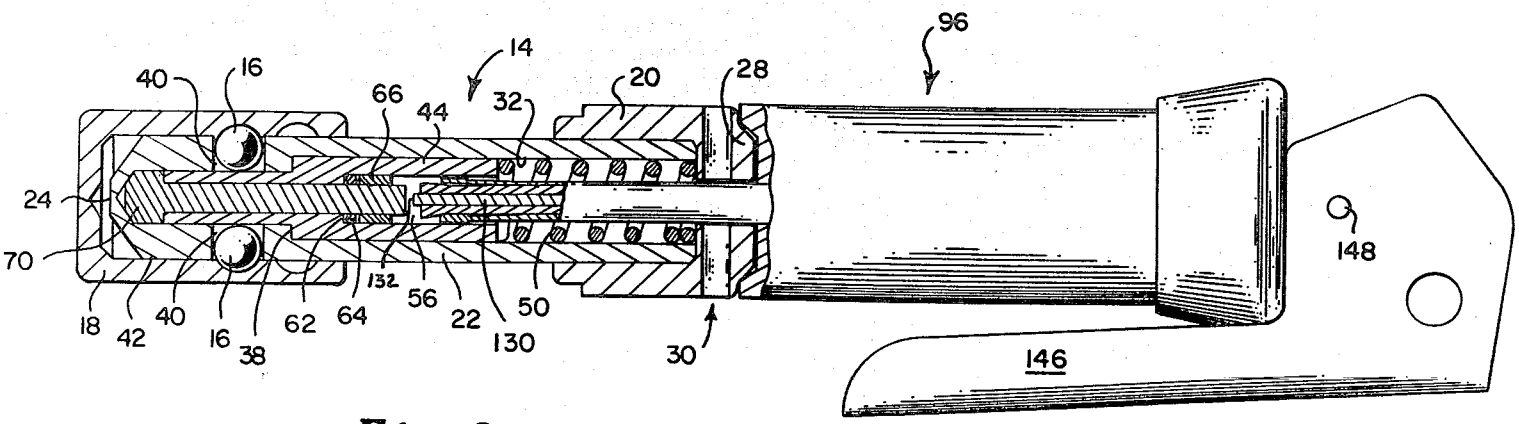
FIG. 2 is a vertical section showing the spring lock of FIG. 1 in its locked condition with the key of this invention shown inserted into the spring lock and with the key handle shown in its first position.

A hollow cylindrical lock plunger 44 is sized, shaped and mounted to reciprocate within the stepped barrel bore 32. In other words, the front exterior portion 46 of lock plunger 44 slidably fits within the front bore 34 of the barrel 22; and the rear exterior portion 48 slidably fits within the rear bore 36 of the barrel 22. The plunger's forward movement is limited by the annular shoulder 38 of barrel bore 32 as shown in FIG. 2. A lock spring 50 is mounted within barrel bore 32 and continuously urges lock plunger 44 forwardly.

Figure 5:
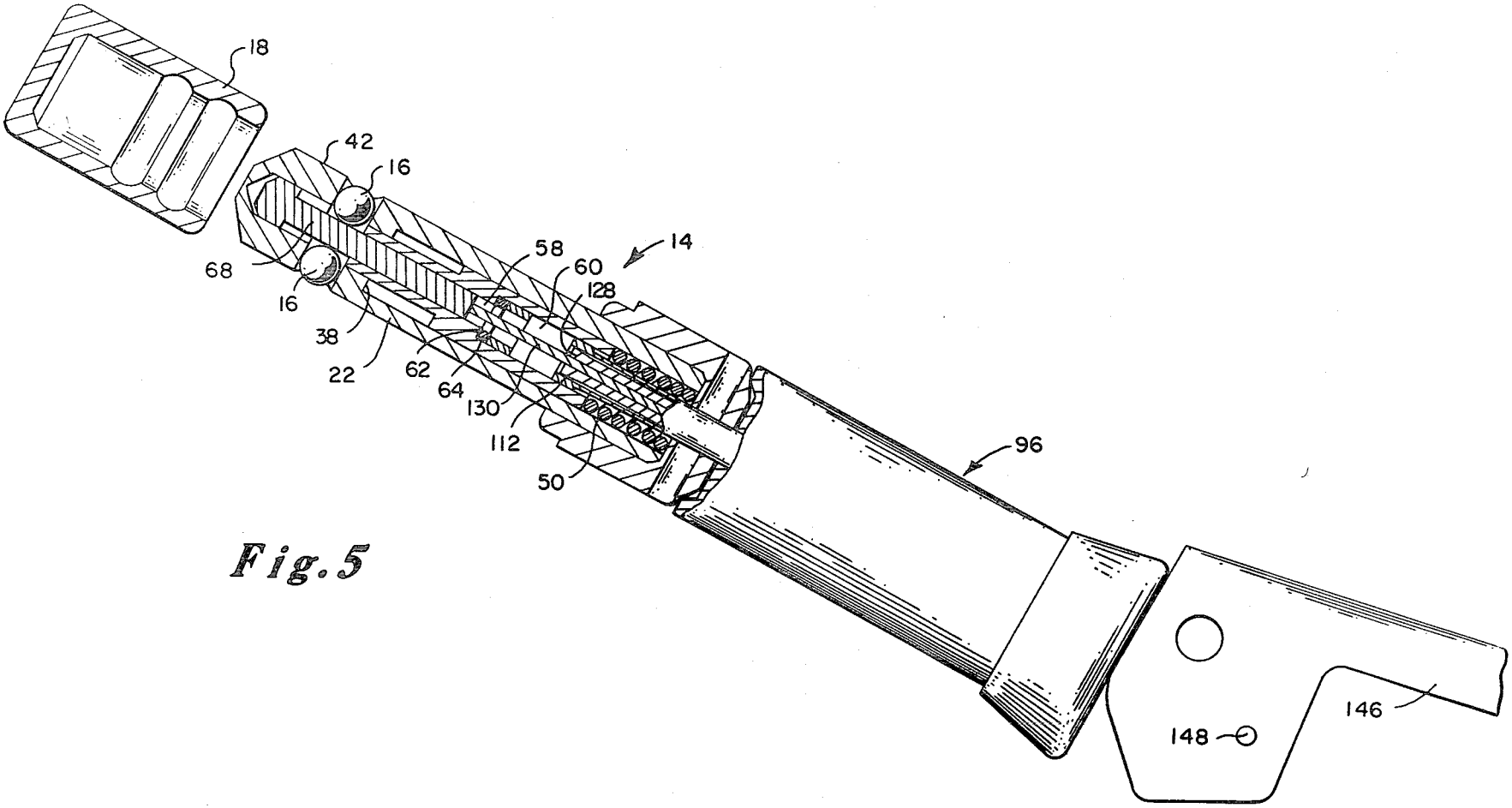
FIG. 5 is similar to FIG. 4 except that the key handle has been pivoted to its fourth position causing the lock plunger to retract fully, the lock plunger clearing the locking ball passageway inner apertures. Because the key center pin maintains the lock center pin forward, the locking balls have moved radially inwardly and the spring lock is now in its unlocked condition and has been longitudinally withdrawn from the front end cap to which it was previously secured.

The front exterior portion 46 of the lock plunger 44 moves forwardly across and closes the inner apertures of both locking ball passageways 40 when the lock is in its locked condition as shown in FIGS. 1 and 2. The lock plunger forces both locking balls 16 radially outwardly to their locking position whenever the lock plunger covers the locking ball passageways 40. However, when the lock plunger 44 moves rearwardly and uncovers the passageways 40, the locking balls move radially inwardly towards the barrel bore 32 as shown in FIG. 5.

The hollow lock plunger 44 has an open front end 52, an open rear end 54, and a stepped axially extending bore 56. The plunger bore 56 has a front bore 58 and a rear bore 60. Bore 58 has a relatively small diameter in comparison to rear bore 60.

The lock plunger 44 also has an annular shoulder 62 in its bore 56 forming the junction between front bore 58 and rear bore 60. The surface of annular shoulder 62 extends perpendicular to the axis of the plunger bore 56 and has the function of acting as an O-ring seat, as will be subsequently seen.

Mounted against annular shoulder 62 is a resilient O-ring 64 which has an inner diameter that is slightly smaller than the inner diameter of front bore 58 of locking plunger 44. In order to maintain O-ring 64 in position against annular shoulder 62, a hollow cylindrical open-ended retainer sleeve 66 is press-fit and fixed in rear plunger bore 60 thereby preventing rearward movement of O-ring 64 within rear plunger bore 60.

A lock center pin 68 has an enlarged head 70 at its front end and has a rearwardly extending shaft 72. The outer diameter of enlarged head 70 is approximately equal to the outer diameter of plunger front exterior portion 46. The outer diameter of center pin shaft 72 is just slightly less than the inner diameter of front plunger bore 58 so that there is a sliding fit therebetween. The center pin shaft 72 extends rearwardly through the open front end 52 of the plunger and reciprocates in the plunger bore 58.

The center pin enlarged head 70 has a sliding fit within front barrel bore 34 and reciprocates therein. There is nothing between the front end of enlarged head 70 and the closed front end of barrel 22. There is no biasing means acting on center pin 68 urging it in any axial direction.

The rear end 74 of center pin shaft 72 extends through O-ring 64 and retainer sleeve 66 when lock plunger 44 is in its fully forward position (FIGS. 1 and 2). It will also be seen that the axial length of lock plunger 44 is greater than the axial length of center pin shaft 72. Thus, the rear end of plunger 44 always extends rearwardly of the rear end 74 of the lock center pin 68.

In the fully locked position shown in FIGS. 1–2, the outer periphery of the center pin shaft 72 is gripped by the inner periphery of the resilient O-ring 64. Therefore, reciprocal axial movement of the lock center pin 68 within plunger front bore 58 is yieldingly resisted by the O-ring. In other words, the O-ring resiliently grips and holds the center pin against axial movement in the plunger bore under all conditions except when an axial force is exerted on the center pin in excess of a selected amount. Then, the center pin will move axially in the plunger bore.

FIGS. 2–5 show the sequence of unlocking steps produced by movement of the key handle. FIG. 2 shows the high security key of this invention fully inserted through the apertured rear end 28 of the lock barrel 22. Plunger 44 is in its fully forward position against annular shoulder 38 of the barrel 22 and the locking balls 16 are forced radially outwardly to their locking position. In FIG. 2, the key handle is in its first position and the key is actually not causing any movement of the lock.

Figure 3:
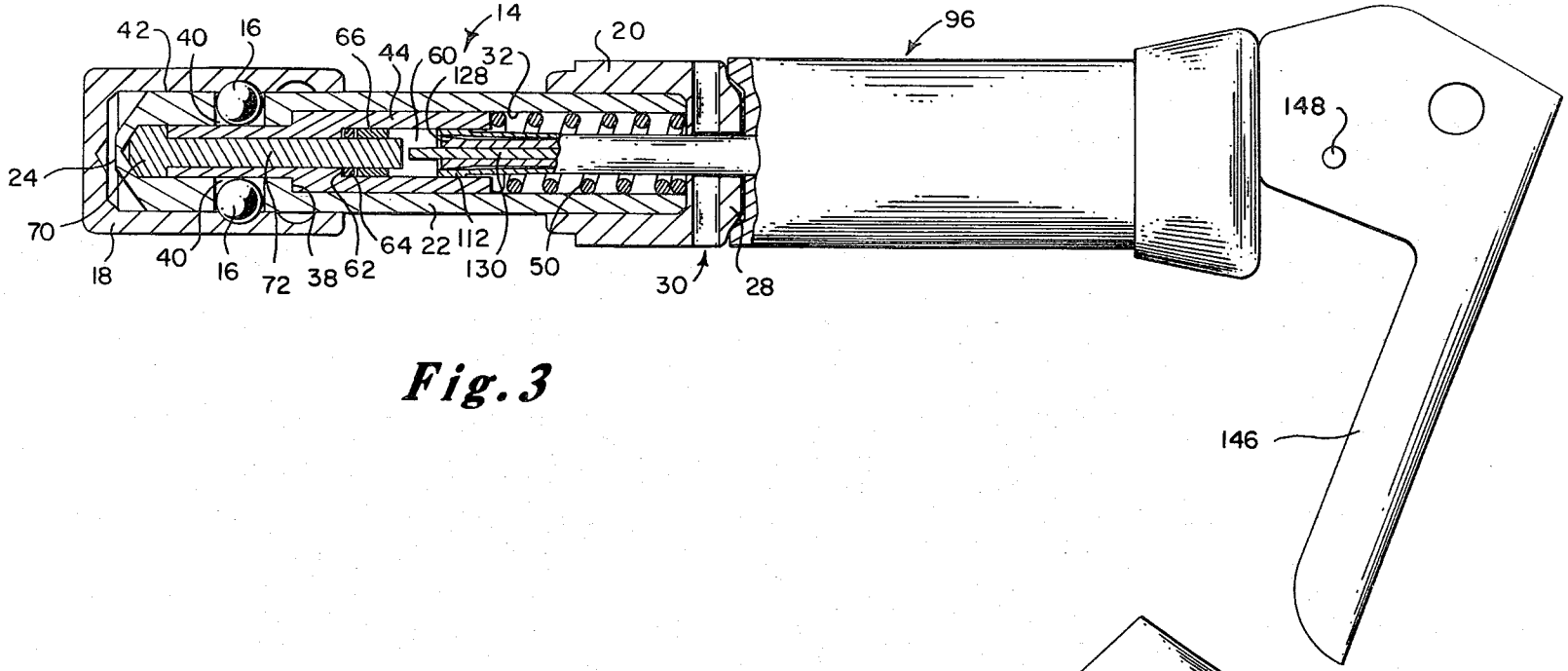
FIG. 3 is similar to FIG. 2 except that the key handle has been pivoted to its second position causing the key's expanding fingers to radially spread and grip the interior of the lock plunger bore.

FIG. 3 shows the key handle rotated to its second position. The lock has not moved at all, but the key has radially expanded to grip the inner surface of the rear plunger bore 60. The key's center pin remains substantially stationary at all times.

Figure 4:
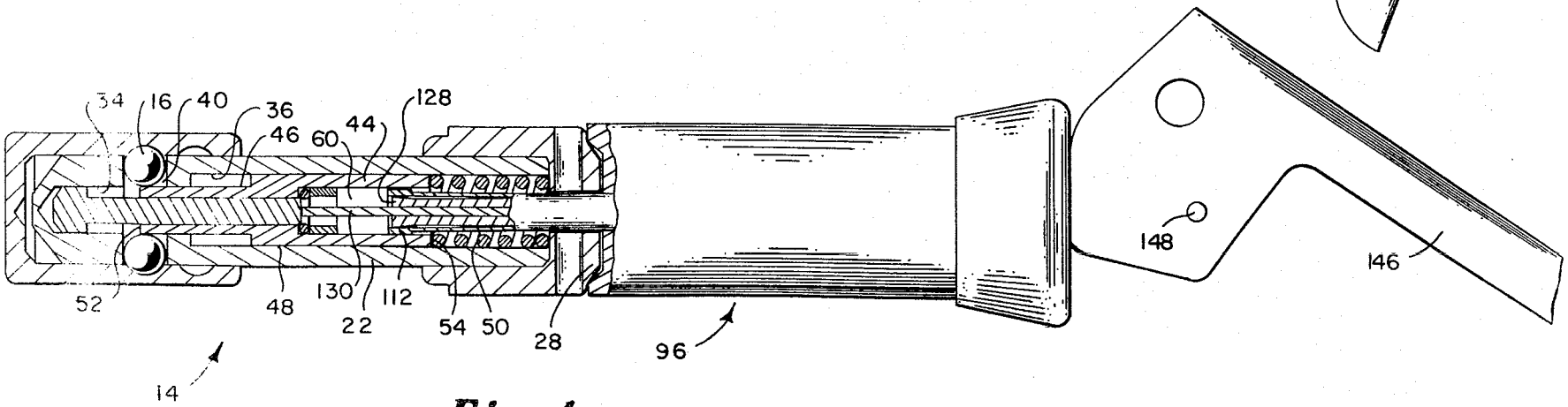
FIG. 4 is similar to FIG. 3 except that the key handle has been pivoted to its third position causing the key expanding fingers to retract the lock plunger while the key center pin prevents the lock center pin from retracting with the lock plunger, the spring lock remaining in its locked condition.

FIG. 4 shows the key handle rotated to its third position. The lock plunger 44 has been retracted somewhat and the key's stationary center pin has blocked the O-ring-gripped lock center pin 68 from retracting with the plunger. In other words, the grip of the O-ring on the lock center pin shaft 72 has yielded and the plunger has moved axially relative to the lock center pin. However, the plunger front exterior portion 46 still maintains the locking balls 16 in their outward locking position.

FIG. 5 shows the key handle rotated to its fourth position. The lock plunger 44 has now been fully retracted to its rearward position and the lock center pin 68 remains stationary in its forward position because of the blocking presence of the key's center pin. At this point, the lock becomes unlocked because the plunger front exterior portion 46 has cleared the inner apertures of passageways 40 and the locking balls are free to move inwardly in the passageways, until they contact center pin shaft 72.

It will be understood from the drawings that if a prior art key or a pick or a nail were inserted in an improper attempt to unlock spring lock 14 by retracting the lock plunger, O-ring 64 would grip and carry center pin 68 to its rearward position along with plunger 44 as the plunger is retracted. Therefore, when plunger front exterior portion 46 cleared the inner apertures of passageways 40, enlarged head 70 of center pin 68 (still abutting the open front end 52 of the lock plunger) would continue to maintain locking balls 16 in their locking position and the lock would remain locked.

FIGS. 1–5 have illustrated the spring lock 14 which is designed to be locked and unlocked only by the high security key of this invention. However, some lock users have expressed a desire for a lock that can be unlocked only by the high security key of this invention, but which can be locked without the use of the high security key. To satisfy this desire, applicants have designed a second preferred embodiment called a springless lock 76 (see FIGS. 6–12).

The springless lock 76 is unlocked in exactly the same manner as the spring lock 14. However, it can be locked by the use of a dumb key or any rod of a specified diameter. In the following description of the springless lock 76, only those elements which are different from the elements in the spring lock 14 will be discussed. Instead of a relatively short retainer sleeve 66, springless lock 76 has a longer retainer sleeve 78. The purpose of the longer retainer sleeve 78 is to ensure that the rear end 80 of sleeve 78 always extends to the rear of the rear end 74 of the lock center pin 68. Stated another way, the combined axial lengths of the plunger front bore 58 and the resilient O-ring 64 and the retainer sleeve 78 are greater than the axial length of the center pin shaft 72. Thus, the center pin shaft cannot extend rearwardly of the lock plunger.

Also, to prevent uncontrolled free sliding movement between lock plunger 44 and lock barrel 22, a peripheral groove 82 is cut into the surface of the rear exterior portion 48 of the lock plunger, and a resilient friction ring 84 (in the form of an O-ring) is mounted within groove 82. The presence of the resilient friction ring 84 causes reciprocal movement of plunger 44 within barrel 22 to be retarded.

Finally, a hollow, cylindrical, open-ended spacer sleeve 86 is coaxially mounted within the rear bore 36 of the lock barrel 22. The purpose of spacer sleeve 86 is to limit rearward movement of the lock plunger and the enlarged head 70 of center pin 68 so that it is impossible for enlarged head 70 to move rearwardly so far as to clear the inner apertures of passageways 40 permitting locking balls 16 to fall completely into front barrel bore 34 (thereby unlocking the lock). In the springless lock, this undesired unlocking could theoretically occur if the lock were being picked or improperly attempted to be unlocked by a prior art key. The spacer sleeve 86 prevents this.

In order to limit rearward movement of the plunger 44, as well as for other reasons, spacer sleeve 86 must have an inner diameter greater than the inner diameter of the retainer sleeve 78 and must have an outer diameter substantially equal to the outer diameter of said lock plunger. Stated another way, spacer sleeve 86 must be sized to limit rearward movement of the lock plunger within lock barrel 22 while permitting entry of a dumb key having an outer diameter equal to the outer diameter of retainer sleeve 78 through the bore of spacer sleeve 86.

FIGS. 7–10 show the steps of unlocking the springless lock 76 which are the same as FIGS. 2–5 which show the steps of unlocking the spring lock 14. However, FIGS. 11–12 show the steps of locking the springless lock 76, and this can be accomplished by using any cylindrical rod having an outer diameter approximately equal to the outer diameter of retainer sleeve 78.

Figure 11:
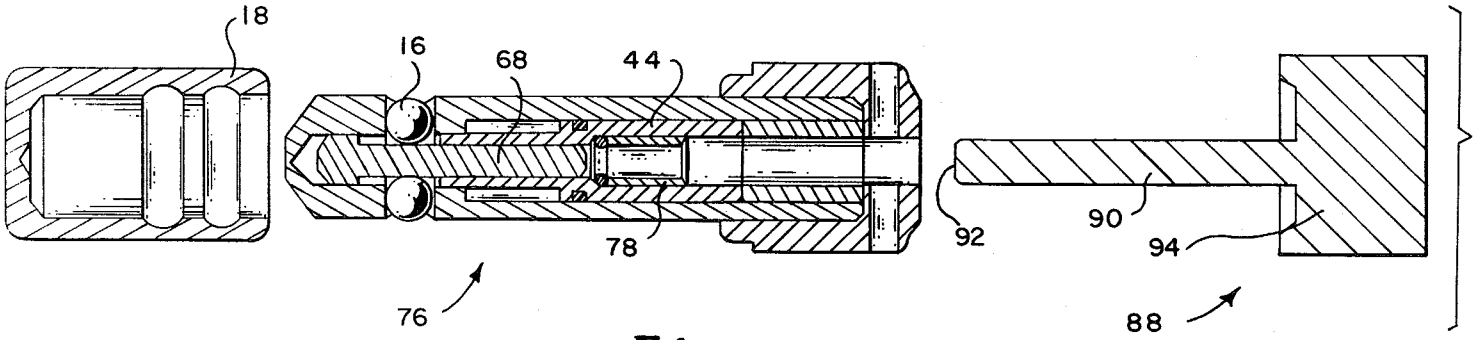
FIG. 11 is a vertical section showing the springless lock of FIG. 6 in its unlocked condition. Also shown is a simple or dumb key of the type given to persons not authorized to use the preferred key of this invention. The FIG. 11 key is used to lock the springless lock, but cannot be used to unlock it.
Figure 12:
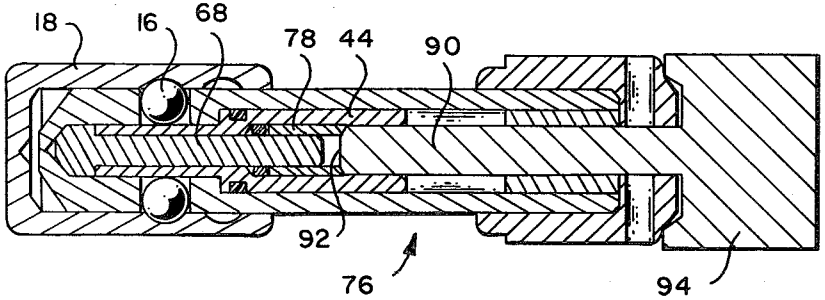
FIG. 12 is a vertical section of the springless lock and dumb key of FIG. 11. The dumb key has been fully inserted into the springless lock causing the lock plunger to move forwardly and the lock to move to its locked condition.

If it is desired to limit the distribution of high security keys to lock openers only, lock installers can be given only a dumb key 88 like that shown in FIGS. 11–12. When the springless lock is removed from front end cap 18 using the high security key, and the key is removed from the lock, plunger 44 does not automatically move forwardly which would cause locking balls 16 to move outwardly to their locking position (see FIG. 1). This does not happen because springless lock 76 has no coil spring 50. Instead, when the springless lock 76 is removed from the front end cap 18, the key handle is rotated back to its first position and the key is removed from the lock. This leaves the lock 76 in its unlocked condition as shown in FIG. 11. That is, the center pin 68 is in its forward position and the lock plunger 44 is in its rearward position. This permits the locking balls 16 to move inwardly against center pin shaft 72.

To lock springless lock 76, the installer manually inserts lock 76 into front end cap 18 and inserts dumb key 88 as far forward as it will go. The key's forwardly extending shaft 90 has a forward end 92 and an enlarged rear end 94. The outer diameter of shaft 90 is preferably approximately equal to the outer diameter of retainer sleeve 78. However, the outer diameter of shaft 90 must be greater than the inner diameter of retainer sleeve 78 and must be smaller than the inner diameter of spacer sleeve 86.

The forward end 92 of the dumb key contacts the rear end of retainer sleeve 78 and pushes lock plunger 44 to its forward position (see FIG. 12). As the front exterior portion 46 of plunger 44 moves forwardly, it forces locking balls 16 outwardly to their locking position, as shown in FIG. 12. The installer cannot thereafter unlock the springless lock 76 with the dumb key 88. Only the high security key will open spring lock 14 or springless lock 76.

The high security key 96 will now be described. FIGS. 7–10 show the key in its four operating positions. Key 96 has a hollow cylindrical key barrel 98 with an apertured front end 100 and an open rear end closed by an aperture cap 102 (creating an apertured rear end).

Two elongated outer expanding fingers 104 extend longitudinally through apertured front end 100 and are fixed at their rear portions to a centrally apertured cylindrical enlarged base 106 which is mounted for axial movement within the bore of key barrel 98 providing a sliding fit therebetween.

A centrally apertured front spacer 108 is positioned to the rear of enlarged base 106 and has an inwardly extending rear rim 110. An outer coil spring 111 is positioned between rear rim 110 and key barrel rear end 102 and biases enlarged base 106 and expanding fingers 104 forwardly. The expanding fingers are formed by taking a hollow cylinder and making two diametrically opposed longitudinal slits which run rearwardly from the front end of the cylinder about half-way towards the rear end of the cylinder. The rear end of the cylinder is fixed to the front of the enlarged base and the tips 112 of the expanding fingers 104 are thickened to provide good gripping surfaces. The fingers 104 are radially spreadable and the finger tips 112 are designed to be spread into a gripping relationship with the interior surface of a hollow bore, such as within lock plunger rear bore 60.

To the rear of enlarged base 106, hollow key plunger 114 is coaxially movably mounted within key barrel 98. Key plunger 114 has an enlarged front end 116 and extends rearwardly through apertured rear end 102 of barrel 98. Plunger front end 116 is free to move forwardly until it contacts the rear surface of enlarged base 106, and is free to move rearwardly until it contacts the front surface of rear rim 110.

A centrally apertured rear spacer 118 is positioned adjacent the apertured rear end 102 of the key barrel 98 and has an outwardly extending rear rim 120 and an inwardly extending front rim 122. The rear end of outer coil spring 111 bears against the forward surface of rear spacer rear rim 120 and keeps front spacer 108 and rear spacer 118 spread apart.

A middle coil spring 124 is telescopically mounted around key plunger 114. The front end of spring 124 bears against the rear surface of enlarged front end 116 of the plunger. The rear end of spring 124 bears against the front surface of front rim 122 of the rear spacer. Middle coil spring 124 keeps the plunger and the rear spacer 118 spread apart.

A hollow cylindrical expander rod 126 is telescopically slidably mounted within the center of the outer expanding fingers 104. Expander rod 126 has a frusto-conical front end 128 which has its maximum diameter at the front. The rear end of expander rod 126 is fixed to key plunger 114 and passes through the apertured front end 100 of the barrel and the enlarged base 106 of the expanding fingers. The length of the expander rod 126 is greater than the length of the expanding fingers (including the enlarged base).

A key center pin 130 is telescopically slidably mounted within the bore of expander rod 126 and has a front end 132 and an enlarged rear end 134. Center pin 130 extends rearwardly through the rear end of expander rod 126 and into the bore of key plunger 114. Enlarged rear end 134 has a sliding fit in the key plunger bore. The length of the key center pin 130 is greater than the length of the expander rod 126.

The plunger 114 has two elongated diametrically opposed slots cut in its intermediate portion forming a transverse slot 136 which has a considerable longitudinal dimension. A stop pin 138 extends through slot 136 and is perpendicular to the axis of the key plunger and the key barrel. The stop pin 138 is fixed to an open-ended hollow cylindrical collar 140 which is telescopically and slidably mounted about the key plunger within the rear spacer 118 and against the rear surface of the front rim 122 of the rear spacer. For all practical purposes, collar 140 and stop pin 138 are fixed against any significant forward or rearward movement relative to the axis of the key plunger, but an adjustment spring 142 is provided about plunger 114 to bias collar 140 forwardly. This adjustment spring is solely for the purpose of compensating for manufacturing variations in the high security and other locks.

An inner coil spring 144 is telescopically mounted on the key center pin 130 within the bore of key plunger 114 and biases the enlarged rear end 134 of the key center pin 130 rearwardly against the stop pin 138.

The key handle 146 is pivotally attached to the rear end of plunger 114 by a pivot pin 148. Key handle 146 is shaped to be rotated in order to progressively retract key plunger 114 and its associated key parts.

Figure 7:
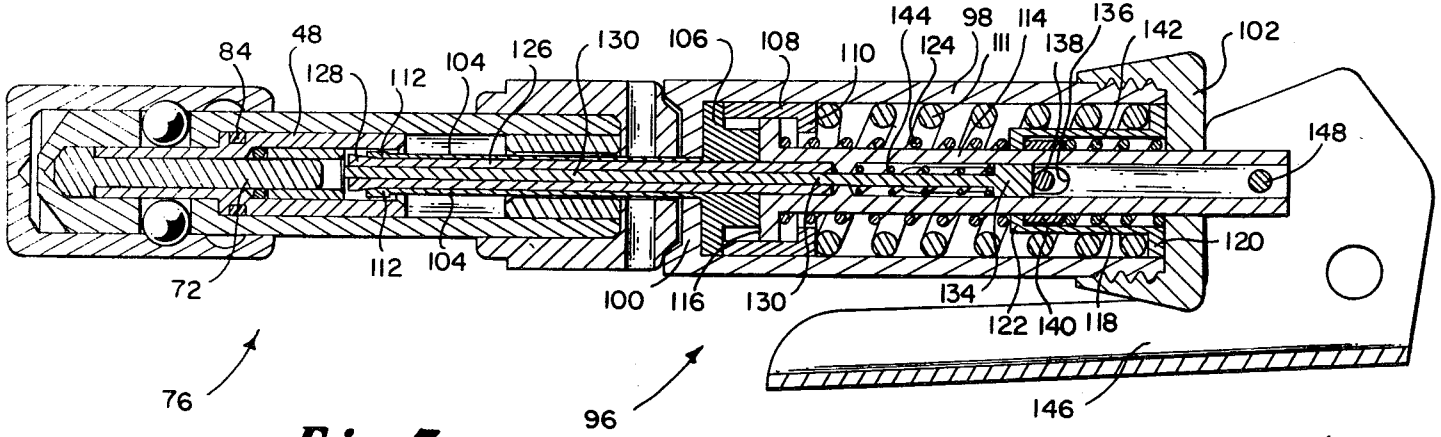
FIG. 7 is a vertical section showing the springless lock of FIG. 6 in its locked condition with the preferred embodiment of the key of this invention also in vertical section. The key is shown inserted into the springless lock.

FIG. 7 shows the key handle in its first position with plunger 114 in its forward position in contact with enlarged base 106 of the expanding fingers 104. Expander rod 126 is in its forward position and the expander rod front end 128 is projected forward of finger tips 112. Thus, finger tips 112 are not spread at all and do not grip lock plunger 44. In the first position (FIG. 7), the key has not acted on the lock at all and the lock remains in its locked condition.

Figure 8:
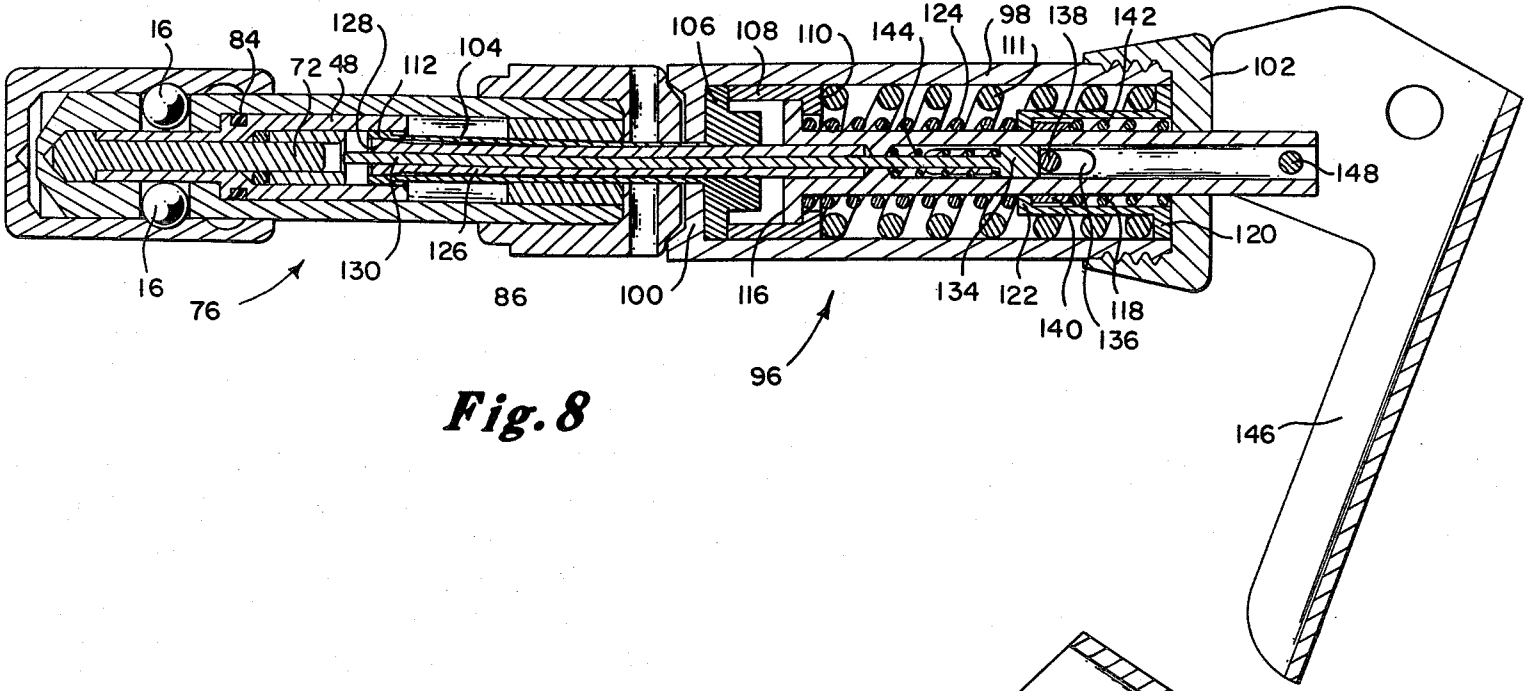
FIG. 8 is a vertical section corresponding to FIG. 3.

FIG. 8 shows the key handle 146 rotated to its second position. Plunger 114 has retracted a small distance and the enlarged front end 116 of the plunger has retracted out of contact with the expanding fingers enlarged front end 116 and into contract with rear rim 110 of front spacer 108. Although plunger 114 has retracted, because of the elongated transverse slot 136, stop pin 138 holds key center pin stationary (where it remains regardless of key handle position). Likewise, outer coil spring 111 holds front spacer 108 forward which in turn holds expanding fingers 104 forward. On the other hand, the retracting key plunger pulls expander rod 126 rearwardly so that the expander rod frusto-conical front end (which has a larger outer diameter than the inner diameter of the expanding fingers) is retracted to the same axial position as the finger tips 112 causing the fingers and finger tips to spread apart radially. Outer coil spring 111 maintains continuous forward axial pressure against fingers 104 resisting their retraction, and expander rod 126 generates continuous rearward axial and radial pressures against the interior of the expanding finger tips causing the tips to spread radially without retracting thereby causing the tips to grip the interior surface of the lock plunger rear bore 60 with substantial force over a considerable area.

Figure 9:
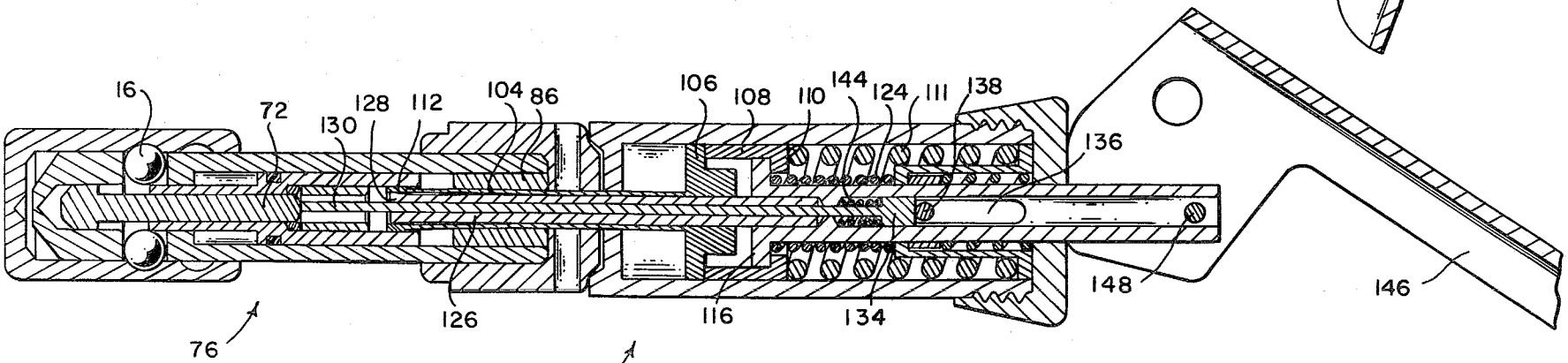
FIG. 9 is a vertical section corresponding to FIG. 4.

FIG. 9 shows the key handle 146 rotated to its third position. The key plunger has been further retracted. This causes the expander rod 126, which is fixed to the plunger, to also retract. The combination of the forwardly urging outer coil spring 111 and the rearwardly pulling expander rod 126 continuously forces the expanding fingers 104 outwardly as the expander rod and the expanding fingers are simultaneously retracted bringing the internally gripped lock plunger 44 with them.

Meanwhile, stop pin 138 continues to block any retraction of key center pin 130 which in turn engages and blocks the lock center pin 68 (see FIG. 9) causing the lock center pin to remain stationary while the lock plunger is retracted. The lock has remained locked throughout the steps of FIGS. 7–9.

Figure 10:
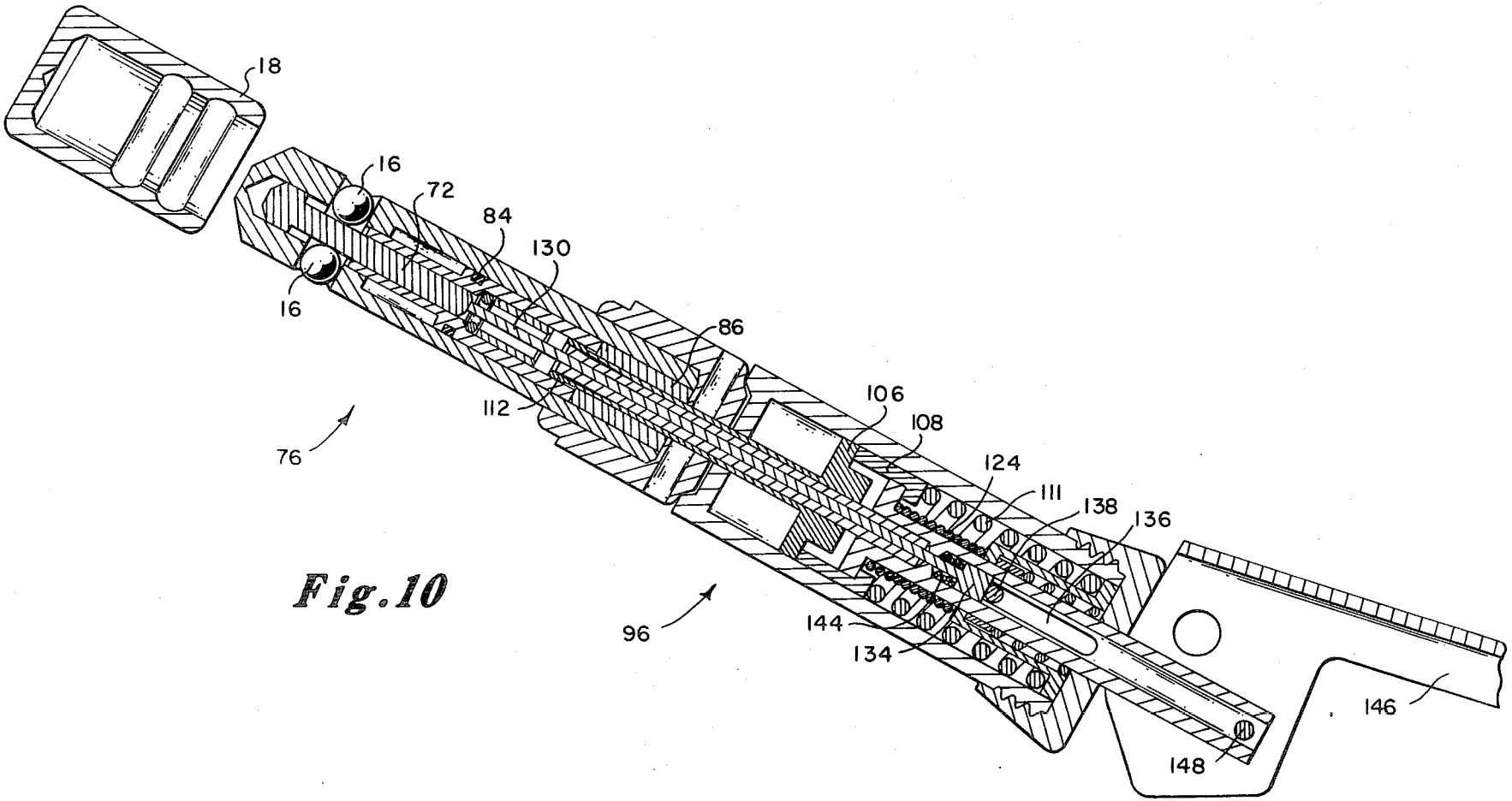
FIG. 10 is a vertical section corresponding to FIG. 5.

FIG. 10 shows the key handle 146 rotated to its fourth and final position. Key plunger 114 has been retracted to its maximum rearward position. The expanding fingers and the expander rod have both been further retracted. The key center pin has continued to hold the lock center pin stationary and the lock plunger has been retracted clear of the passageways 40 permitting the locking balls to move inwardly and the lock to become unlocked and to be removed from front end cap 18. As FIG. 10 shows, all three springs 111, 124, and 144 have been greatly compressed by the action of the key handle, and the spread-apart expanding fingers have continued to exert a strong grip on lock plunger 44. While all of these retracting activities have been occurring, the key center pin 130, the stop pin 138, the elongated transverse slot 136, and the inner coil spring 144 have cooperated to prevent the lock center pin from being carried by O-ring 64 along with the retracting lock plunger 44. Thus, the high security key can unlock either spring lock 14 or springless lock 76, as well as many prior art locks. However, the high security locks 14 and 76 can only be unlocked by the high security key 96.

The above description obviously suggests many possible variations and modifications of this invention which would not depart from its spirit and scope. It should be understood, therefore, that the invention is not limited in its application to the details of structure specifically described or illustrated and that, within the scope of the appended claims, it may be practiced otherwise than as specifically described or illustrated.

We claim:

1. A high security key comprising:

(a) a hollow cylindrical key barrel having an apertured front end and an apertured rear end;

(b) at least two elongated outer expanding fingers extending longitudinally forward through said key barrel apertured front end, said outer expanding fingers being fixed at their rear portions to an enlarged base which is axially movably mounted within and biased towards said front end of said key barrel, said outer expanding fingers having radially spreadable finger tips;

(c) a hollow key plunger extending longitudinally rearwardly through said key barrel apertured rear end, said key plunger being axially movable within said key barrel, said key plunger positioned to the rear of said expanding fingers enlarged base and having a longitudinally extending transverse slot formed through the intermediate portion of said key plunger;

(d) a hollow cylindrical expander rod having an enlarged forward head, said expander rod telescopically sliding within said expanding fingers, the length of said expander rod being greater than the length of said expanding fingers, the rear end of said expander rod being fixed to said key plunger;

(e) a key center pin telescopically sliding within said expander rod and biased towards the rear end of said key plunger, the length of said key center pin being greater than the length of said expander rod;

(f) a stop pin extending through said key plunger transverse slot, said stop pin positioned rearwardly of the rear end of said key center pin and positioned perpendicular to the axis of said key barrel, said stop pin being fixed against substantial movement relative to the axis of said key barrel;

(g) a key handle pivoted to the rear end of said key plunger, said key handle being manually pivotable to axially reciprocate said key plunger between a forward locked position in which said expander rod head is positioned forward of said expanding finger tips and said expanding finger tips are unspread, and a rearward unlocked position in which said expander rod is retracted rearwardly to initially spread said forwardly biased expanding fingers, and to subsequently pull said fully spread expanding fingers rearwardly, said stop pin maintaining said rearwardly biased key center pin stationary relative to said key barrel axis, the forward end of said key center pin being positioned forward of the spread finger tips of said expanding fingers in the key plunger rearward unlocked position.

2. The high security key of claim 1 wherein said expanding fingers are a portion of a hollow cylinder which has two diametrically opposed longitudinal slits running rearwardly from the front end of said cylinder, said cylinder being fixed at its rear end to said enlarged base.

3. The high security key of claim 2 wherein said enlarged base is a disc having an outer diameter corresponding to and being slightly smaller than the inner diameter of said key barrel.

4. The high security key of claim 1 wherein said key plunger is biased forwardly.

5. The high security key of claim 2 wherein the outer diameter of said expander rod enlarged head is greater than the inner diameter of said expanding fingers.

6. The high security key of claim 1 wherein said key center pin is blocked by said stop pin from retracting towards said key barrel as said expander rod and spread-apart expanding fingers are retracted towards said key barrel.

7. The high security key of claim 1 wherein an axially positioned outer coil spring biases said expanding fingers enlarged base forwardly, a coaxially positioned middle coil spring biases said key plunger forwardly, and a coaxially positioned inner coil spring biases said key center pin rearwardly, all said coil springs acting continuously.

* * * * *